US005292443A

United States Patent [19]

Esche, Jr. et al.

[11] Patent Number: 5,292,443

[45] Date of Patent: Mar. 8, 1994

[54] PROCESS FOR PRODUCING NEUTRALIZED SULFURIZED ALKYLPHENATE LUBRICANT DETERGENT ADDITIVE

[75] Inventors: Carl K. Esche, Jr., Wappinger Falls; Gregory P. Anderson, Beacon, both of N.Y.; John R. Sanderson, Leander, Tex.

[73] Assignee: Texaco Inc., White Plains, N.Y.

[21] Appl. No.: 933,621

[22] Filed: Aug. 21, 1992

[51] Int. Cl.[5] ..... C10M 105/72

[52] U.S. Cl. ..... 252/42.7; 252/46.4

[58] Field of Search ..... 252/48.2, 42.7, 46.4, 252/18

[56] References Cited

U.S. PATENT DOCUMENTS

| | | | |
|---|---|---|---|
| 3,755,170 | 8/1993 | Rogers et al. | 252/18 |
| 3,932,289 | 1/1976 | King et al. | 252/18 |
| 4,218,330 | 8/1980 | Shubkin | 252/46.6 |
| 4,228,022 | 10/1980 | Lowe et al. | 252/42.7 |
| 4,382,004 | 5/1983 | Tassara | 252/49.7 |
| 4,514,313 | 4/1985 | Le Coent | 252/42.7 |
| 4,664,824 | 5/1987 | Chang et al. | 252/42.7 |
| 4,710,308 | 12/1987 | Stauffer | 252/18 |
| 4,865,754 | 9/1989 | Chang | 252/39 |
| 4,973,411 | 11/1990 | Jao et al. | 252/33.2 |
| 5,053,569 | 10/1991 | Marquis | 585/18 |

*Primary Examiner*—Margaret Medley

*Attorney, Agent, or Firm*—James J. O'Loughlin; Vincent A. Am Mallare

[57] ABSTRACT

A non-diluent oil process for producing a fluid sulfurized/neutralized phenate comprising:

a) oligomerizing a ($C_6$–$C_{20}$) olefin;

b) alkylating the oligomerized olefin to produce a oligomerized ($C_6$–$C_{20}$) alkyl phenol;

c) neutralizing and sulfurizing the oligomerized ($C_6$–$C_{20}$) alkyl phenol to produce a fluid neutralized/sulfurized phenate product; and d) recovering said fluid phenate product.

4 Claims, No Drawings

PROCESS FOR PRODUCING NEUTRALIZED SULFURIZED ALKYLPHENATE LUBRICANT DETERGENT ADDITIVE

BACKGROUND OF THE INVENTION

This invention relates to alkylphenates, and more particularly to a non-diluent process for producing fluid neutralized, sulfurized alkylphenates.

Generally, it is known that neutralized sulfurized alkylphenates and overbased sulfurized alkylphenates are common detergent and antioxidant additives used in motor oils. Typically, phenates contain diluent oil to make the product fluid and to facilitate plant handling. Diluent oil is added to dissolve the neat metal phenate salt which is very viscous when heated and will solidfy/gel upon cooling.

Unfortunately, the presence of diluent oil reduces the amount of soap and other active components in the detergent additive. Thus a higher treat of the detergent additive is required in the motor oil to compensate for the diluent oil. Also the shipping and handling costs are higher since the inert diluent oil containing the dissolved phenate must also be shipped and stored. Therefore, it would be advantageous to manufacture phenates without diluent oil and maintain a fluid product.

Thus it is an object of this invention to provide a non-diluent oil process for making a fluid alkylphenate that is substantially or all a detergent additive (i.e., soap) for lubricants.

DISCLOSURE STATEMENT

U.S. Pat. No. 5,053,569 discloses a process for preparing synthetic lubricant base stocks. Synthetic lubricant base stocks may be prepared in good yield by oligomerizing linear olefins using certain acidic calcium montmorillonite clay catalysts. When the oligomers are hydrogenated, they provide a synthetic base stock having excellent thermal and oxidative stability properties.

U.S. Pat. No. 4,973,411 discloses the addition of diluent oil during the phenate synthesis for detergent additives and in the examples, the neutralized sulfurized phenate and the sulfurized alkylphenol were previously dissolved in solvent neutral oil.

The U.S. Pat. No. 4,865,754 discloses the preparation of an overbased detergent additive containing a mixture of overbased phenate and sulfonate dissolved in a diluent oil. In the process, diluent oil is added in the begining and again at the end during product workup.

U.S. Pat. No. 4,664,824 discloses the preparation of overbased sulfurized phenates made from alkylphenols having an alkyl group from 8 to 40 carbons. A mixture containing the long chain alkylphenol, elemental sulfur, a dihydric alcohol, an alkaline earth metal compound, lubricating oil, and a high boiling linear monohydric alcohol are heated to a temperature range of 250–400F. The resulting intermediate product is then contacted with carbon dioxide at a second temperature below 380F. to provide for a carbonated product mixture.

SUMMARY OF THE INVENTION

This invention provides a non-diluent oil process for producing a fluid neutralized/sulfurized phenate comprising:

a) oligomerizing a ($C_6$–$C_{20}$) olefin;

b) alkylating the oligomerized olefin to produce an oligomerized ($C_6$–$C_{20}$) alkyl phenol;

c) neutralizing and sulfurizing the oligomerized ($C_6$–$C_{20}$) alkylphenol to produce a fluid neutralized/-sulfurized phenate product; and d) recovering the fluid phenate product.

DETAILED DESCRIPTION OF THE INVENTION

Through use, lubricating oils tend to deteriorate in today's automotive and diesel engines. This invariably leads to sludge and varnish deposit formation on the internal working parts of an engine, especially piston rings, lands, skirts, and grooves. These deposits have harmful effects on engine performance and life. Various additives are added to the lubricating oil to extend the life of the oil and to inhibit deposit formation on the engine's internal working parts. These additives are antioxidants, detergents, and dispersants. Antioxidants are additives that tend to reduce the tendency of lubricating oils to thicken and to form oxidation by-products. Those additives that solubilize and disperse the oxidation by-products, varnish, and sludge are called detergents and dispersants respectively.

The calcium salts of sulfurized alkylphenols are known to exhibit strong antioxidant and detergent like properties in a lubricating oil. These sulfurized calcium phenates when used in the proper proportion relative to other additives, act to prevent the buildup of sludge and varnish deposits in an engine.

According to the present invention, a phenate additive has been developed which delivers more cleaning power (detergency) than similar additives provided in the prior art. The present additive is prepared without a diluent oil and it is a fluid product as well.

The present phenate detergent additive is made by a non-diluent oil process and produces a fluid sulfurized calcium phenate which process comprises:

a) oligomerizing a (C6–C20) olefin:

b) alkylating the oligomerized olefin to produce an oligomerized (C6–C20) alkylphenol:

c) neutralizing and sulfurizing the oligomerized (C6–C20) alkylphenol to produce a fluid neutralized/sulfurized phenate product: and d) recovering the fluid phenate product.

The olefins (i.e., alkenes) which may be used in the present invention include those listed below in Table I.

TABLE I

1-Hexene
1-Heptene
1-Octene
1-Nonene
1-Decene
2-Decene
3-Decene
2-Undecene
3-Undecene
4-Undecene
3-Tetradecene
4-Tetradecene
1-Undecene
1-Dodecene
1-Tridecene
1-Tetradecene
1-Pentadecene
1-Hexadecene
1-Heptadecene
1-Octadecene
1-Nonadecene 1-Eicosene The preferred olefins are $C_{10}$ to $C_{14}$ olefin including 1-Decene through 1-Tetradecene, as listed above in Table I.

The sulfurization and neutralization of the alkylphenol are accomplished in the presence of elemental sulfur and calcium hydroxide.

Other sulfur reagents may be used instead of elemental sulfur such as $SCl_2$ and $S_2Cl_2$.

To further describe the present invention, the conventional detergent additive is usually a mixture that contains the following ingredients: a) soap b), diluent oil, c), possibly a base. The soap is used to keep the engine clean. One of the conventional detergent additives used today is the calcium salt of a sulfurized alkylphenol. In general, the calcium salt of a sulfurized alkylphenol tends to be a solid or a very viscous material due to the ionic nature of the calcium-alkylphenol bond. This property can be influenced by the alkyl group whose purpose is two fold: 1) to increase the fluidity of the calcium sulfurized phenate and 2) to increase the solubility of the phenate in oil. The diluent oil is added to solubilize the otherwise solid or nearly solid detergent additive. The diluent oil also facilitates plant handling of the product by making the product less viscous. Therefore, motor oil detergent additives are usually a mixture of the detergent additive and a diluent oil. This mixture may also contain a base in the form of a metal carbonate. This material is formed during the overbasing step. The metal carbonate, typically a calcium carbonate, is present to neutralize acids formed during the combustion process.

It is not necessary that all detergent additives be overbased. A motor oil typically contains several different detergent additive types which may or may not be overbased.

In the past, phenate fluidity relied more on the diluent oil than on the inherent liquifying structure of the alkyl group. However, by properly modifying the structure of the alkyl group, the fluidity of the calcium sulfurized phenate is increased to such an extent that the need for the diluent oil is overcome. We believe that oligomerizing the olefin provides for a unique structure that effectively fluidizies the calcium sulfurized phenate and negates the need for a diluent oil.

In Table II shown below, a comparison is made to illustrate the difference between a conventionally prepared alkylphenate detergent additive and a phenate prepared according to the present invention.

TABLE II

| CONVENTIONALLY PREPARED PHENATE | PRESENT INVENTION PREPARED PHENATE |
|---|---|
| 1:1 overbased | |
| Neutralized sulfurized | Neutralized sulfurized |
| C—$_{24}$–$C_{28}$ alkylphenate | Oligomerized $C_{14}$ olefin alkylphenate |
| Olefin: $C_{24}$–$C_{28}$ alpha | Olefin: Oligomerized $C_{14}$ alpha olefin |
| $C_{24}$–$C_{28}$ alkylphenol | Oligmerized $C_{14}$ |

TABLE II-continued

| CONVENTIONALLY PREPARED PHENATE | PRESENT INVENTION PREPARED PHENATE |
|---|---|
| alkylphenol | Alkylphenol |
| Fluid ? – No. | Fluid ? – Yes. |
| Composition of Product* | Composition of Product* |
| % Soap = 46.7 | % Soap = 100 |
| % $CaCO_3$ = 3.3 | % $CaCO_3$ = 0.0 |
| % Pale Oil - 50.0 | % Pale Oil = 0.0 |
| Analytical data: | Analytical Data: |
| % S = 1.6 | % S = 1.93 |
| % Ca = 2.7 | % Ca = 3.45 |
| TBN = 72.5** | TBN = 88.0** |

*Theoretical yield based on chemicals charged during the reaction and assuming reaction goes to completion.

**TBN - total base number and represents the acid neutralization ability of the final product. The higher the number the more acid the detergent additive can neutralize.

In the case of the conventionally prepared detergent additive based on a linear ($C_{24}$–$C_{28}$) alkylphenol, the starting material is a solid whereas the Oligomerized $C_{14}$ olefin alkylphenol is a liquid. In this instance, the oligomerization process lends an advantage to the product by allowing the starting material, i.e., the alkylphenol to be a fluid liquid as opposed to a solid.

Examination of the composition of the final product shows the conventionally prepared product to contain approximately 47% soap or detergent additive and 50% pale oil, the diluent oil. However, in the present invention, the final detergent additive based on the dimerized $C_{14}$ alkylphenol contains nearly double the amount of soap and contains no diluent oil.

Hence, the present invention allows for a detergent additive to contain in theory 100% soap and be absent of diluent oil.

In order to illustrate the present invention and its advantages, the following Examples are provided.

EXAMPLE I

Preparation of Alkylphenol

Procedure: Phenol, catalyst, and olefin oligomer bottoms are charged to a flask equipped with a mechanical stirrer, thermometer, and water cooled condenser. The mixture is heated to the desired temperature for the desired time with vigorous stirring. Reaction conditions of runs A–D are shown below in Table III. At the end of the reaction, the mixture is cooled to ambient temperature and filtered with suction. The liquid is vacuum distilled to a head temperature of >150C. at <1 mmHg. The liquids are analyzed by LC,IR,NMR,and GPC. The results are shown below in Table III.

In Table III, the term "Clay-13" is an acid treated clay with highly acidic properties and high surface area. These clays are specifically referred to as "SMECTITES" which are 2:1 clay minerals that carry a lattice charge and characteristically expand when solvated with water and alcohols, notably ethylene glycol and glycerol.

The term 14 oligo. means oligomerized with a 14 carbon olefin such as 1-Tetradecene.

TABLE III

ALKYLATION OF PHENOL USING ACID CLAYS

| Run No. | Phenol (g) | Olefin | (g) | Catalyst | (g) | Time (Hr.) | Temp. (C) | Alkyl-phenol (%) | Substituted Mono | Substituted DI |
|---|---|---|---|---|---|---|---|---|---|---|
| A | 400.0 | 14 oligo Btms. | 800 | Clay-13 | 120 | 2.0 | 140 | 77 | 89 | 10 |
| | | | | | | 2.0 | 160 | | | |
| | | | | | | 2.0 | 170 | | | |
| B | 800.0 | 14 oligo | 1600 | Clay-13 | 240 | 2.0 | 140 | 76 | 95 | 3 |

TABLE III-continued

ALKYLATION OF PHENOL USING ACID CLAYS

| Run No. | Phenol (g) | Olefin | (g) | Catalyst | (g) | Time (Hr.) | Temp. (C) | Alkyl-phenol (%) | Substituted Mono | Substituted DI |
|---|---|---|---|---|---|---|---|---|---|---|
| | | Btms. | | | | 3.0 | 160 | | | |
| C | 600.0 | 12 oligo | 2000 | Clay-13 | 500 | 2.0 | 120 | 85 | 65 | 35 |
| | | Btms. | | | | 2.0 | 140 | | | |
| D | 600.0 | 10 oligo | 2000 | Clay-13 | 500 | 2.0 | 120 | 73 | — | — |
| | | Btms. | | | | 2.0 | 140 | | | |

EXAMPLE 2

Neutralized and Sulfurized C-14 Dimerized Phenol using Excess Base

Into a round bottom flask equipped with a stirrer, reflux condensor, thermometer, thermocouple, and gas inlet tube were added the following: C14 Oligomerized alkylphenol as prepared in example 1-B ( 125 gms, 0.243 moles, mol weight determined by GPC), elemental sulfur (8.80 gms, 0.275 moles), calcium hydroxide (18 grams, 0.243 moles). The mixture was heated to 125° C. under nitrogen (200ml/min) with stirring. Concurrently, ethylene glycol (15.0 gms, 0.158 moles) was slowly added to the reaction mixture. The temperature was increased to 170° C. and the reaction mixture is stirred for 4 hours. The product was filtered hot through celite and solvent stripped under vacuum on a rotovap to yield 84 gms of product. Found analytical data: % Ca 3.45, % S=1.93, TBN=88, and viscosity at 100C.=32.41 cSt.

EXAMPLE 3

Neutralized and Sulfurized C-12 Dimerized Phenate

Into a round bottom flask equipped with a stirrer, reflux apparatus, thermometer, thermocouple, and gas inlet tube were added the following: C12 Oligomerized alkylphenol as prepared in Experiment 1-C (99.0 gms, 0.243 moles, molecular weight determined by GPC), elemental sulfur (8.80 gms, 0.275 moles), calcium hydroxide (10.0 gms, 0.134 moles). The mixture was slowly heated to 125° C. under nitrogen (200 ml/min) with stirring. Ethylene Glycol (15.0 gms,0.158 moles) was slowly added while the reaction was being heated. The temperature was increased to 170° C. and stirred for four hours. The reaction was halted, allowed to cool, 25 ml of heptane added and then filtered through celite. The recovered product was solvent stripped under vacuum on the rotovap at 170° C. for 30–45 minutes to yield 82 gms. Found analytical data: % Ca 3.14, % S=2.07, TBN=77, Vis at 100° C.=17.8 cSt.

EXAMPLE 4

Neutralized and Sulfurized $C_{10}$ Oligomerized Phenate

Into a round bottom flask equipped with a stirrer, thermocouple, thermometer, Dean Stark trap , condensor, and gas inlet tube were added the following: C10 Oligomer alkylphenol as prepared in experiment 1-D (155 gms, 0.400 mol, molecular weight determined by GPC), elemental sulfur (14.50 gms, 0.452 mol), calcium hydroxide (15 50 gms, 0.210 mol). The reaction mixture was vigorously stirred while being heated to 125° C. under nitrogen (200 mL/min). Concurrently, ethylene glycol (16.0 gms, 0.260 moles) was slowly added to the reactants. The reaction was heated to 170° C. and stirred for four hours. The reaction was allowed to cool and heptane (20 ml) was added. The product was then filtered through celite and stripped of solvent on a rotovap under vacuum at 170° C. for 30–45 minutes to yield 144.5 gms of product. Found analytical data: % Ca=4.09, % S=2.94, TBN=102.9 and viscosity at 100° C.=39.9 cSt.

EXAMPLE 5

150 TBN Overbased Sulfurized C14 Oligomer Phenate

Into a round bottom flask equipped with a reflux condensor, thermometer, thermocouple, stirrer, gas inlet tube were added the following ingredients: C14 Oligomer alkylphenol as prepared in experiment 1-B (125 gms, 0.243 mol., molecular weight determined by GPC) elemental sulfur (8.80 gms, 0.275 mol), ethylene glycol (15 gms, 0.158 mol), and calcium hydroxide (20.0 gms, 0.270 mol). The mixture was stirred while being heated to 125° C. under nitrogen (200 ml/min). While heating, the ethylene glycol (15 gms, 0.158 mol) was slowly added. The reaction was heated to 170° C. and stirred for four hours. The reaction was cooled to 40° C., the nitrogen gas was stopped, and heptane (114 gms) and methanol (32.5 gms) were added. The reaction was heated to 50° C. and carbon dioxide was bubbled into the reagents at 100 ml/min for exactly 25 minutes. The product was filtered through celite and the solvent stripped on a rotovap at 170° C. under vacuum for one hour to yield 110 gms of product. Found analytical data: % Ca=6.08, % S 1.79, TBN=151, and viscosity @100° C.=70.96 cs.

EXAMPLE 6

200 TBN Overbased Sulfurized C10 Oligomerized Alkylphenate

Into a round bottom flask equipped as in example 5 were added the following: C10 Oligomer alkylphenol as prepared in experiment 1-D (155 gms, 0.400 mol, molecular weight determined by GPC) elemental sulfur (14.50 gms, 0.452 Mol) calcium hydroxide (31.0 gms, 0.420 mol). The mixture was then heated to 125° C. under nitrogen gas (200 ml/min). While heating, the ethylene glycol (25.4 gms, 0.410 mol) was slowly charged to the reaction vessel. The reaction was heated to 170° C. and stirred for four hours. The nitrogen gas was heated and carbon dioxide 100ml/min was bubbled into the reactants for 44 minutes. The reaction was cooled, 25 ml of heptane was added with stirring, and then filtered through celite. The solvents were removed on the rotovap under vacuum at 170C. for 45 minutes to yield 163 gms of product. Found analytical data % Ca 7.73, % S=2.48, TBN= 202, and viscosity at 100° C. =60.68 cSt.

EXAMPLE 7

Preparation of 1:1 Overbased Sulfurized ($C_{24}$–$C_{28}$) Alkylphenate

Into a round bottom flask equipped as in experiment 5 were added the following: C24-28 alkylphenol (750 grams, 1.140 moles, and 686 grams of crude heptane. Reactants were slowly stirred to dissolve the alkyphenol. Nitrogen gas (200 ml/min) was bubbled into the reaction mixture. While maintaining the reaction temperature close to room temperature, sulfur dichloride was added (79 gms, 0.764 moles) dropwise into the reaction mixture with vigorous stirring. After the addition was completed, the reaction was stirred for 30 minutes. The reaction was cooled to 45° C. and the calcium hydroxide (186 grams, 2,510 moles) methanol (195 grams, 6.09 moles) and 848 grams of pale oil to the reaction mixture. The nitrogen gas flow was stopped and the reaction stirred for one hour at 55° C. While maintaining the reaction temperature at 55° C., carbon dioxide gas was bubbled into the reactants at 120 ml/min for 106 minutes. The product was filtered through filter aid and solvent stripped on a rotovap under vacuum with an oil bath temperature of 100° C. Found analytical data: % Ca=2.72, % S=1.62, % Cl=0.1720, TBN=72.5, and viscosity at 100° C.=14.4 cSt.

EXAMPLE 8

Engine Test

To examine the performance of this novel phenate, a sample was prepared as in Example 4 and had the following analytical data: Ca=6.96%, S=2.53, TBN=184.25.

The additive was blended into an SAE 30 oil and run in an MWM-B engine test as described in CEC-L-12A-76 (coordinating) European Council for the Development of Performance Tests for Lubricants and Engine Fuels) and DIN (German Institute for Standardization) 51361 (part 4). This test involves running the engine for 50 hours to evaluate the oil's effect on ring sticking, wear, and accumulation of deposits under high temperature conditions. The oil containing the detergent additive achieved, 64 merits, a satisfactory rating for this formulation.

We claim:

1. A non-diluent oil process for producing a fluid neutralized/sulfurized phenate comprising:

a) oligomerizing a ($C_6$–$C_{20}$) olefin;

b) alkylating phenol with said oligomerized olefin to produce a oligomerized ($C_6$–$C_{20}$) alkyl phenol;

c) neutralizing and sulfurizing said oligomerized ($C_6$–$C_{20}$) alkyl phenol, with $Ca(OH)_2$, ethylene glycol and elemental sulfur in the absence of an oil diluent to produce a fluid neutralized/sulfurized phenate product; and d) recovering said fluid phenate product.

2. The process of claim 1 wherein said olefin is selected from the group consisting of 1-Hexene, 1-Heptene, 1-Octene, 1-Nonene, 1-Decene, 1-Undecene, 1-Dodecene, 1-Tridecene, 1-Tetradecene, 1-Pentadecene, 1-Hexadecene, 1-Heptadecene, 1-Octadecene, 1-Nonadecene and 1-Eicosene.

3. The process of claim 1, wherein said olefin is 1-Tetradecene.

4. The process of claim 1 wherein said olefin is 1-Decene.

* * * * *